US005908142A

United States Patent [19]

Sacchetti

[11] Patent Number: 5,908,142

[45] Date of Patent: Jun. 1, 1999

[54] BEER TAP DISPLAY SYSTEM WITH CUSTOMIZABLE PROGRAMMING AND MULTI-MEDIA OUTPUT MEANS

[76] Inventor: David M. Sacchetti, 19805 Holiday Rd., Grosse Pointe Woods, Mich. 48236

[21] Appl. No.: 08/885,648

[22] Filed: Jun. 30, 1997

Related U.S. Application Data

[60] Provisional application No. 60/020,949, Jul. 1, 1996.

[51] Int. Cl.[6] ..... B67D 1/07

[52] U.S. Cl. ..... 222/25; 222/39; 222/192

[58] Field of Search ..... 222/39, 25, 394, 222/192; 40/332, 448, 463, 457

[56] References Cited

U.S. PATENT DOCUMENTS

| | | | |
|---|---|---|---|
| 3,752,192 | 8/1973 | Kleppin | 40/332 X |
| 3,762,086 | 10/1973 | Horbinski . | |
| 3,956,934 | 5/1976 | White . | |
| 4,107,777 | 8/1978 | Pearson et al. . | |
| 4,162,028 | 7/1979 | Reichenberger . | |
| 4,216,529 | 8/1980 | Krystek et al. . | |
| 4,225,057 | 9/1980 | Horn . | |
| 4,979,641 | 12/1990 | Turner . | |
| 5,586,691 | 12/1996 | Gotch et al. | 40/332 X |

*Primary Examiner*—Gregory L. Huson

*Attorney, Agent, or Firm*—Gifford, Krass, Groh, Sprinkle, Anderson & Citkowski, P.C.

[57] ABSTRACT

An audio/visual display system incorporated into a beverage dispenser assembly, the dispenser assembly including a spigot, a flow/non-flow dispensing handle operatively engaging the spigot and a selected beverage for dispensing through the spigot. A structure is arrayed atop the dispenser assembly and includes an advertising display for presenting visual advertising including both textual and graphical components. A central processor unit is either incorporated into the structure in communication with the advertising display or provided in a stand alone computerized hard drive which is connected to the structure. The processor unit is capable of storing audio/visual messages, being inputted with custom created messages and presenting menu displays corresponding to stored messages. An accompanying audio playback component is arranged in operative communication with an output of the processor unit and is either provided with an audio playback transducer incorporated within the display system structure or as a stand alone speaker arranged in proximity to the display system.

14 Claims, 5 Drawing Sheets

BEER TAP DISPLAY SYSTEM WITH CUSTOMIZABLE PROGRAMMING AND MULTI-MEDIA OUTPUT MEANS

This application claims the benefit of U.S. Provisional Application No. 60/020,949, filed Jul. 1, 1996.

BACKGROUND OF THE INVENTION

1. Field of the Invention

The present invention relates generally to information display devices and, more particularly, to a beer tap or beer tower arrangement which incorporates a customizable display system with multi-media output means into a display portion incorporating an information display carrier and a visual display means.

2. Description of the Related Art

Visual display means are fairly well know in the art, the most typical of which is the electronic display board which is supplied by an external processor with data and which displays the data in a scrolling manner across the display face of the board. Such display boards are typically found in bars and other type establishments and are useful in relating such information as sporting event scores and other news.

The primary disadvantage of such display means involves their relatively large size which makes difficult optimal location of the display board for viewing by the patrons of the establishment. An additional disadvantage of these display means is that they are usually hooked into an external processor control and supply means such that the information they display is not controlled by the establishment and, consequently, food and beverage specials of the establishment cannot be displayed.

An example of a computerized beer dispensing system which includes a tap display is described in U.S. Pat. No. 4,979,641, issued to Turner. The primary objective of Turner is to disclose a dispensing system which tracks variables of draft beer dispensings, such as accounting, inventory control, price variations and time periods associated with price variations. An additional feature taught by Turner is the annunciating of public relation type messages and this is provided in part by front and rear displays located on associated front and rear faces of a dispenser housing, from which also extends a dispensing tap. The displays are identified as being of vacuum fluorescent construction and are capable of displaying all the programmed functions relating to the variables of the beer dispensing system. Turner also teaches that the displays present additional programmed messages including beer advertisements and other location operator programmed announcements during default of the primary programming functions. According to this feature, an operator can select the content and time duration of standard or customized computer generated messages which are displayed at desired intervals and are stored in a message queue.

While teaching an interesting secondary display feature of a beer dispensing tap which is otherwise primarily directed to dispensing and accounting functions, the advertising display aspect of Turner suffers from the shortcoming that the output is limited to a flashing or scrolling written message presented across the display faces. Turner does not appear to be either intended or suited for providing advertising and entertainment display, particularly of a multi-media nature, in which both audio and visual design aspects are used selectively in combination with printed messages. The advantage of such multi-media outputs is to provide a more discernable and sophisticated audio/visual presentation for a beer tap dispensing assembly than that which is currently afforded by the prior art.

SUMMARY OF THE PRESENT INVENTION

The present invention is an audio/visual display system which is incorporated into a beverage dispenser assembly, particularly a beer tap assembly, for presenting advertising information in an effective and entertaining fashion within taverns and like establishments to patrons situated in and around the area of the tap assembly. The existing dispenser assembly normally includes a spigot, a flow/non-flow dispensing handle operatively connected to the spigot by an on/off valve which regulates the flow of fluid and actuable to communicate a source of a selected beverage, usually a beer or malt liquor, for dispensing through the spigot.

The display system includes a structure which is arrayed atop the dispenser assembly and which includes one or more advertising display screens. positioned thereon. According to one preferred embodiment at least one, and preferably two, planar faced display screens are provided on oppositely facing surfaces of the structure and the structure may in turn be incorporated into an upwardly extending portion of the flow/non-flow handle. In a further preferred embodiment, the advertising display is a circular extending screen in a substantial ring shape which is capable of scrolling messages in circumferential fashion.

A processor means for operating the audio/visual display system includes a central processing unit which is capable of outputting a first stream of signals corresponding to a visual display for presentation on the one or more advertising display screens and a second stream of signals corresponding to an audio component for playback on an audio/transducer or speaker. In order to accomplish audio playback, a sound integration circuit is incorporated into the processor memory board and a digital to audio conversion means converts appropriate digital signals into an audio output component to complement the visual or written messages displayed upon the screen. The memory means further permit access to a plurality of messages which are stored therein and a program play button may be accessed to scroll through a listing of the audio/visual advertising messages stored within the processor memory.

In a selected embodiment, the features of the processor unit, visual display and audio playback are all incorporated into the display system structure which is in turn either incorporated into the beer tap handle or may alternatively be mounted atop a tower having a plurality of individual beverage dispensers. Alternatively, the processor unit may be incorporated into a stand alone hard drive which is operatively connected to the display system structure for providing the visual display and a separate speaker is arranged in proximate fashion relative to the visual display for providing accompanying audio output. In either embodiment, a keyboard is provided for creating customized messages for storage within the processor memory and for playback by the processor and may either be connected to a programming input port of a structure incorporating the processor and visual/audio components or alternatively to the computer hard drive which in turn communicates with the visual display. The visual display screen is also preferably of the type utilizing liquid crystal (LCD), light emitting diode (LED), or vacuum fluorescent (VFD) electronic display technology and, in combination with the central processor and memory means, is capable of producing both textual and graphical display images in both still and moving/scrolling fashion in tandem with a suitable audio output.

BRIEF DESCRIPTION OF THE DRAWINGS

Reference will now be had to the attached drawings, when read in combination with the following specification, wherein like reference numerals refer to like parts throughout the several views, and in which.

DESCRIPTION OF THE PREFERRED EMBODIMENTS

Figure 1:
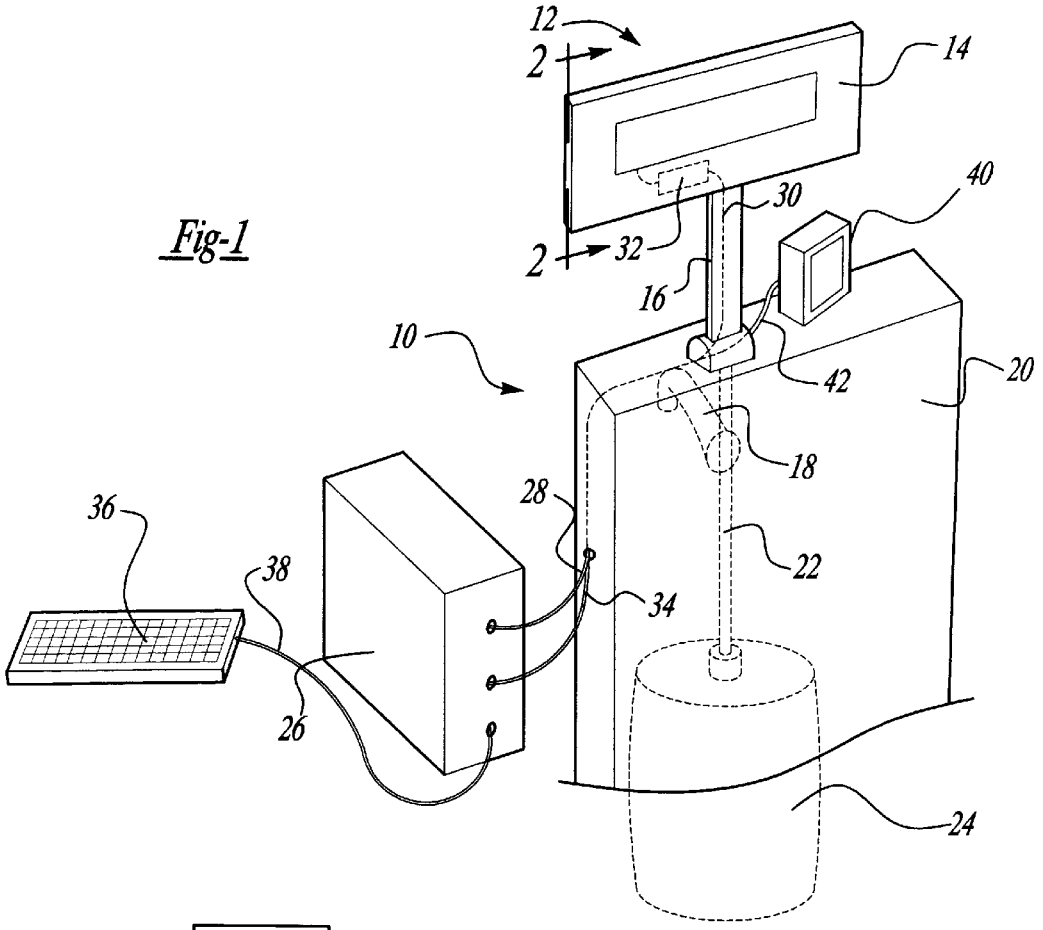
FIG. 1 is a perspective view of the audio/visual display system according to a preferred embodiment of the present invention.

Referring to FIG. 1, the audio/visual display system of the present invention is shown at 10 and includes a beer tap display for displaying messages electronically. The basic components which make up the system 10 include a beer tap which has a display head body 12 and at least one planar face 14 upon which is situated a display screen. The body 12 is mounted atop a stem or handle portion 16 which attaches to a valve body 18 and, as is conventionally known in the art, is pivoted in a forward direction to open the valve and to distribute the beer or ale through a pressurized line.

The valve body and spigot arrangement 18 may project from a superstructure, such as of the type shown at 20, or may extend upwardly through a counter or other flat planar surface. As is also known in the art, a fluid line 22 extends from valve and spigot and connects to a barrel or keg 24 which stores the beer or ale product to be distributed. The present invention is directed to the visual display system of the beer tap and the discussion of the fluid supply means is only intended to illustrate the environment within which the present invention is utilized.

Referring again to FIG. 1, and according to a first preferred embodiment of the present invention, a computer with hard drive component 26 may be provided and is preferably positioned in a hidden location in close proximity to the beer tap display. At least one line 28 extends from the computer with hard drive 26, along or inside the stem portion 16, and into the display head 12 at an input 30. The line 28 transports electronic/digital data from the hard drive into the display head 12 for presentation on the display screen. A power source 32 may be built into the display head 12 for providing illumination to the display screen or, alternatively, an additional power line connection 34 may attach to the computer with hard drive directly to an AC/DC power source to provide power to the system.

According to this preferred embodiment, a steady stream of advertising and other data is sent from the computer with hard drive 26 via the line 28 and into the display head. A keyboard 36 is provided and connects to the computer with hard drive 26 by line 38. The keyboard 36 is provided so that the content of the information supplied by the hard drive may be changed at any time to take into consideration such things as food and drink specials and other information which change often and for which ease of modification is desired. At least one audio speaker 40 can be provided and is powered by another line 42 extending from the hard drive 26 and preferably branching off from the main line 28 hooking the computer with hard drive into the display head portion. A discussion on the circuitry involved in powering the audio means will be had upon reference to the disclosure of FIG. 3.

Figure 2:
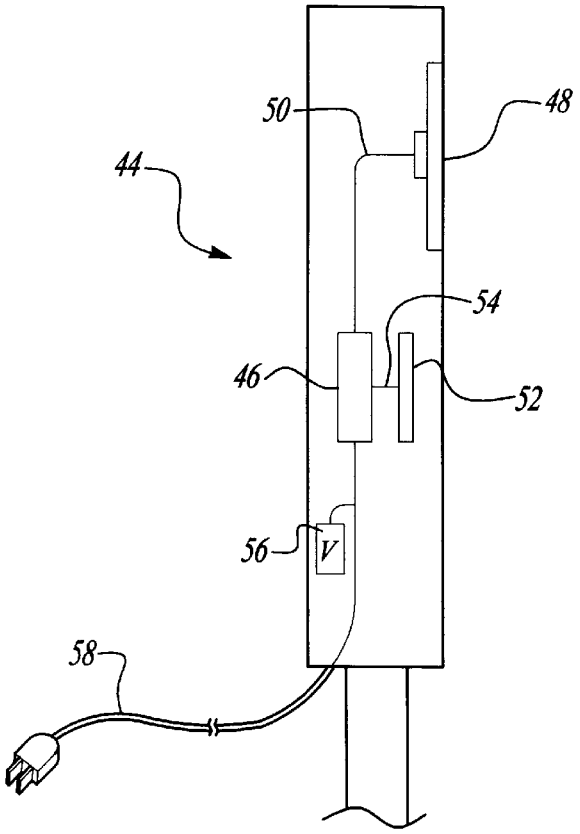
FIG. 2 is a cutaway view taken along line 2—2 of FIG. 1 and illustrating a further preferred variant of the display system of the present invention such as is illustrated according to FIG. 1.

Referring now to FIG. 2, a modification 44 of a display head portion of a beer tap according to the audio/visual display system of the present invention is illustrated in cutaway. The embodiment of FIG. 2 differs from that illustrated in FIG. 1 primarily in that the computer with drive is replaced by an integrated microprocessor or controller IC 46 built into the display head for providing the desired messages to a visual display 48 via a line 50 extending therebetween. A quantity of information may be stored in a look-up table 52 in communication with the microprocessor 46 by a line 54 and the microprocessor is capable of being programmed to retrieve the proper information for presentation on the visual display.

A number of different means may be employed to control the operation of the microprocessor or controller, as well as the information stored in the circuit comprising the look-up table. Such means may include the similar provision of a key entry means (keyboard) or the provision of replaceable and substitutable circuit boards into the look-up table to automatically change the content of the displayed messages. A power supply for operating the visual display is also provided and again may comprise either a portable battery source 56 or an external AC/DC power source 58.

Figure 3:
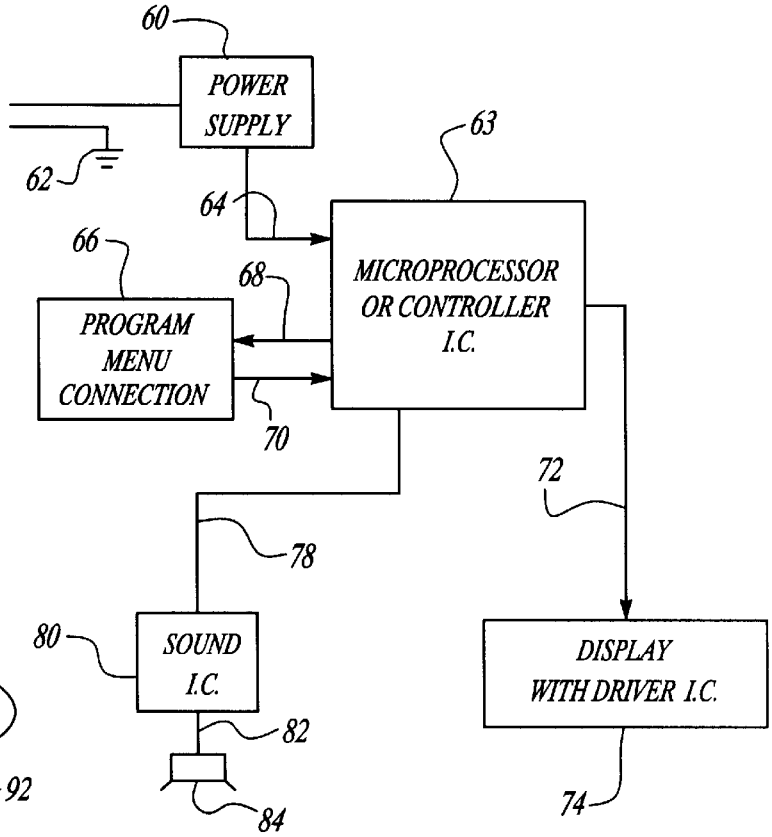
FIG. 3 is a block diagram view of an electrical connection scheme for the display system according to the first preferred embodiment of the present invention.

Referring now to FIG. 3, a simplified block diagram of the electrical control scheme for operating the information display is illustrated and includes a power supply 60 and a line dedicated to ground at 62. The power supply 60 is connected to a microprocessor 63 via line 64 to provide power to the display system. A programming connection circuit, typically provided by the look-up table or other information input device, is illustrated at 66 and connects to the microprocessor 63 by lines 68 and 70. Specifically, the microprocessor 63 inputs a signal to the program connector 66 on line 68 querying the retrieval of a desired quantity of information. The retrieved information is sent back to the microprocessor on line 70 and is sent to the lookup table in the microprocessor and, upon proper conversion, is outputted along line 72 to a visual display 74. The information is displayed or, preferably scrolled, along the screen comprising the display 74.

Finally, a series of signals representative of an audial output are sent from the microprocessor 63 along a line 78 extending between the microprocessor 63 and a sound integration circuit 80. The circuit 80 preferably incorporates digital to analog (DAC) conversion technology so that the digitized signals representative of the audial output are converted and outputted along a line 82 to a speaker 84 for broadcast concurrent with the electronically displayed images.

The visual images are further preferably displayed electronically in a red or other color which contrasts a black background to achieve the optimal visual effect. This is particularly desirable where there is not very much lighting and this is common in many bars. However, the present invention also contemplates the possibility of providing the visual display as a liquid crystal (LCD) display or VF (vacuum florescent technology) and the appropriate technology could be incorporated into the processing means to accomplish this. The diagram of FIG. 3 is also applicable to either of the preferred embodiments of FIGS. 1 and 2 and also of FIG. 5 which will be subsequently described.

Figure 4:
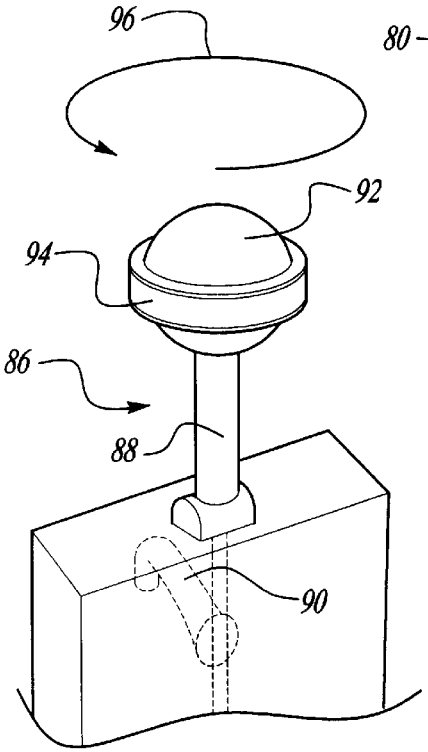
FIG. 4 is a sectional view of an alternatively configured beer tap with display head according to a further preferred embodiment.

FIG. 4 illustrates a further variant of an electronic information display 86 according to the present invention and includes a stem or handle portion 88 which connects at a lower end thereof to a valve and spigot arrangement 90. Mounted atop the stem portion 88 is an enlarged spherical body portion 92. A visual display screen 94 is provided in a generally circumferential manner ringing the spherical body portion 92 and the display information can be scrolled along the screen 94 in a direction indicated by the arrow 96 and according to any of the fashions previously described.

Figure 5:
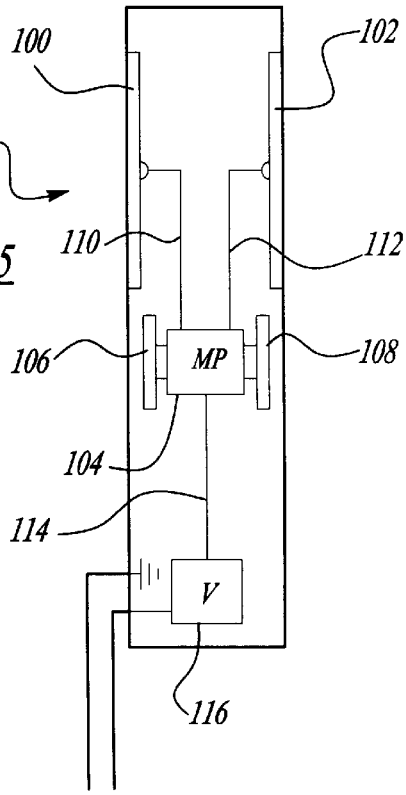
FIG. 5 is a cutaway sectional view, similar to that shown in FIG. 2, of a further modified display head with built-in processing means and both front and rearwardly positioned display screens according to the present invention.

Referring to FIG. 5, a further modification of a display member 98 is shown and includes a pair of front and rear display screens 100 and 102 formed respectively on opposite planar faces of the display member 98. A microprocessor 104 located within the display member can includes one or more information retrieval/look-up tables, illustrated as separate IC's 106 and 108, and can concurrently retrieve desired information from either or both of the tables in order to provide either the same or different visual outputs to either of the display screens 100 and 102. The retrieved information is outputted along lines 110 and 112 to the screens 100 and 102 respectively. A line 114 communicates a power source 116 to the microprocessor (MP) and the information display can otherwise function as previously described.

Figure 6:
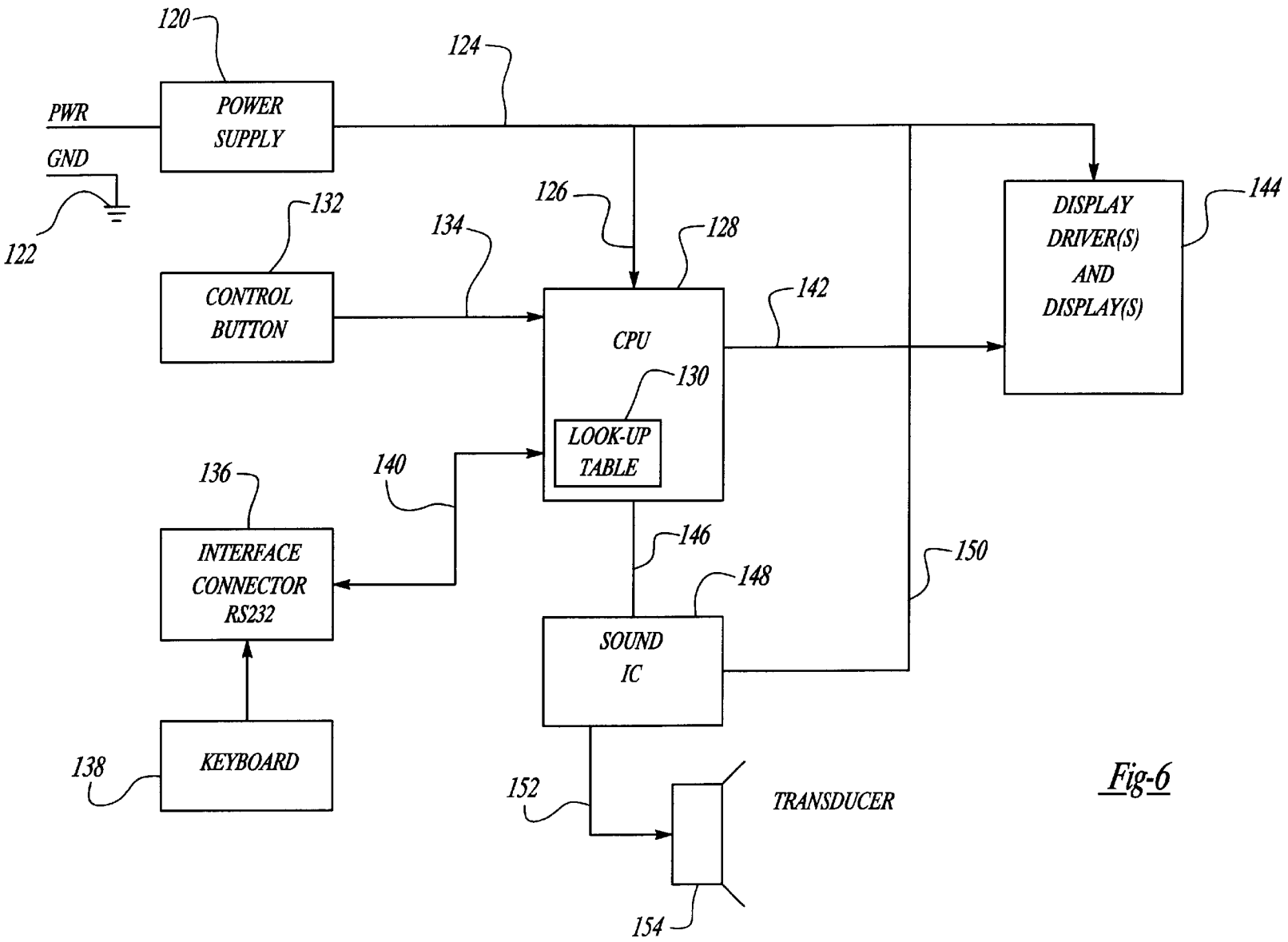
FIG. 6 is a schematic view similar to that shown in FIG. 2 and illustrating a processor arrangement according to a further preferred embodiment of the present invention.

Referring now to FIG. 6, a schematic is illustrated of a component and wiring sequence for operating the audio/visual display system according to a further preferred embodiment of the present invention and includes a power supply 120 connected to ground at 122. A power supply line 124 extends from the power supply 120 and, upon being provided with a flow of current, supplies power through a further line 126 to a central processor unit 128. The central processor unit 128 according to this embodiment also includes an internal memory or look-up table 130 from which the processor unit 128 may select stored values representative of audio/visual presentations as will be subsequently described. The schematic of FIG. 6 also substantially discloses a processor and audio/visual output assembly capable of being integrated within a display structure such as will be described with further reference to FIGS. 7 and 8 and which may form a part of a flow/non-flow dispensing handle of an existing beverage dispenser assembly.

Figure 7:
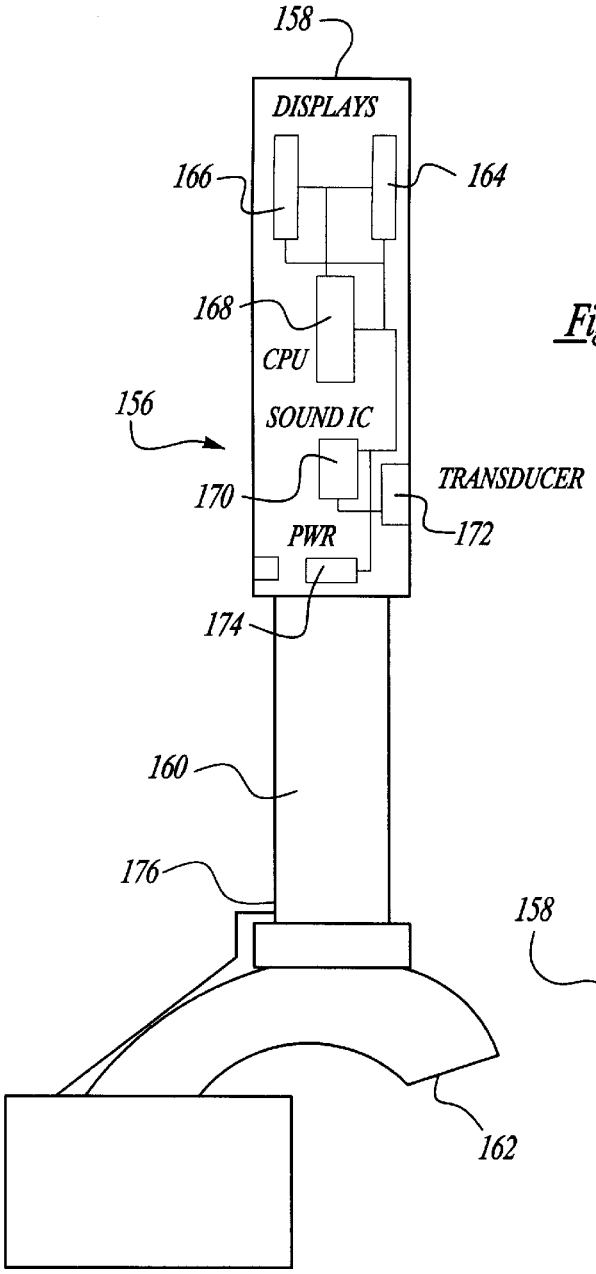
FIG. 7 is a side view in cutaway of a display system structure incorporating a schematic arrangement such as is set forth in FIG. 6 and arranged upon a spigot handle of a dispenser assembly with front and rear screen displays and an audio output.
Figure 8:
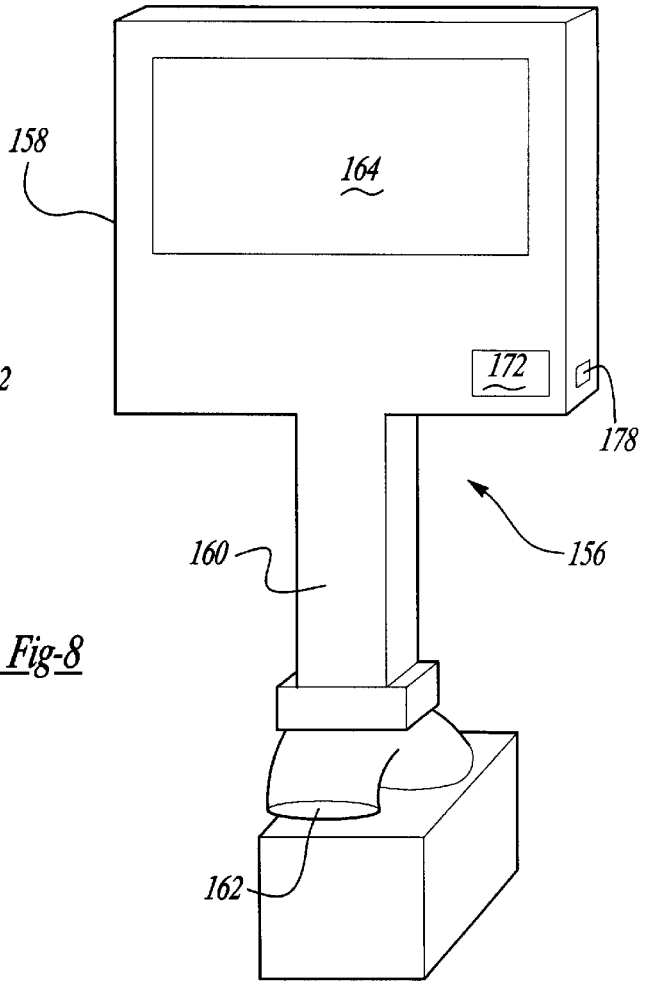
FIG. 8 is a perspective view of the display system as substantially shown in FIG. 7.

Referring again to FIG. 6, a control button 132 is illustrated in operative communication with the central processor unit 128 through an input line 134. The control button 132 provides the primary function of accessing a menu of selections which may be contained within the program memory 130 of the processor 128 and which upon being depressed may display the selections on an advertising display face, such as has been previously illustrated or is also shown in FIGS. 7 and 8. The control button 132 may also provide the function of initiating power supply to the circuit such as by depressing the button 132 a single time and may then be depressed and held for a second or so in order to access the menu display contained within the program memory/look-up table 130 of the microprocessor 128.

An interface connector 136 is likewise provided and serves as an input port for a program customizing means according to the instant embodiment. The interface connector 136 is provided as a component which is well known in the art such as is designated by part number RS232 and operatively connects an externally mounted computer keyboard 138 with the central processor 128 through an input line 140. The interface connector 136 provides the primary function of converting key entered values into a digitized format capable of being stored, interpreted and signaled in turn by the processor and internal memory.

As was previously disclosed, the central processing unit 128 is capable of receiving, storing, retrieving and issuing commands representative of both audio and visual advertising display messages. A first output line 142 of the central processor unit 128 communicates with a display driver 144 and represents schematically the provision of a first stream of variables representative of a visual display for presentation on an advertising display. The display driver 144 is concurrently supplied by electrical power as is evidenced by its input from the main power line 124.

A further output line 146 extends from the central processing unit 128 and communicates with a sound integrated circuit 148 which is also operatively connected by the main power line 124 through a branching input line 150. The sound integrated circuit 148 serves the function of converting a digitized output stream from the central processing unit into an analog signal, such in turn being communicated through a further line 152 to an output transducer 154. The output transducer 154, as will be subsequently illustrated with reference to FIGS. 7 and 8, is capable of being incorporated within the display system structure and for outputting audial playback in tandem with the visual display.

Referring now to FIGS. 7 and 8, frontal cutaway and side views, respectively, are illustrated of an audio/visual display system 156 such as may be constructed according to the previously described by the schematic arrangement of FIG. 6 and which are incorporated into a display structure 158 forming a part of a flow/non-flow dispensing handle 160 of a conventional beverage dispenser assembly and which further includes a dispensing spigot 162 from which a desired beverage (not shown) is poured. Referring specifically to FIG. 7, a cutaway of the display structure 158 illustrates in schematic form, somewhat similarly to what is shown in FIG. 6, the arrangement of the processor, visual and audio output components according to this preferred embodiment of the present invention.

Specifically, a first planar face advertising display is illustrated at 164 along a first facing side of the display structure 158 and a second such planar face advertising display 166 is likewise illustrated at 166 along a second facing side of the structure 158. A central processing unit 168 with built-in memory operatively communicates through outputs to the first and second planar face displays 164 and 166 and likewise communicates with a sound integration circuit 170 and an audio output transducer 172 as described with reference to FIG. 6. A power supply is illustrated at 174 and may be provided by either an internal battery or a power cord which extends to an external and remote AC/DC power outlet (not shown). A programing port 176 is also illustrated proximate a base of the handle 160 integrally formed with the structure 158 and provides an input to which an external keyboard (not shown) is connected for customized programming of audio/visual display messages for playback.

Referring again to FIG. 8, the first planar advertising display face 164 is illustrated in a size typically represented on the display structure 158 and the transducer 172 for outputting an audio playback is likewise illustrated. A control button 178, corresponding to schematically illustrated element 132 in FIG. 6, is shown on a side surface of the display structure and, as has been previously described, may be operatively depressed in a first fashion to power on/power off the display system and may further be depressed in a second fashion to bring up a menu display on the advertising display face 164 from the central processor 168 and internal memory.

Figure 9:
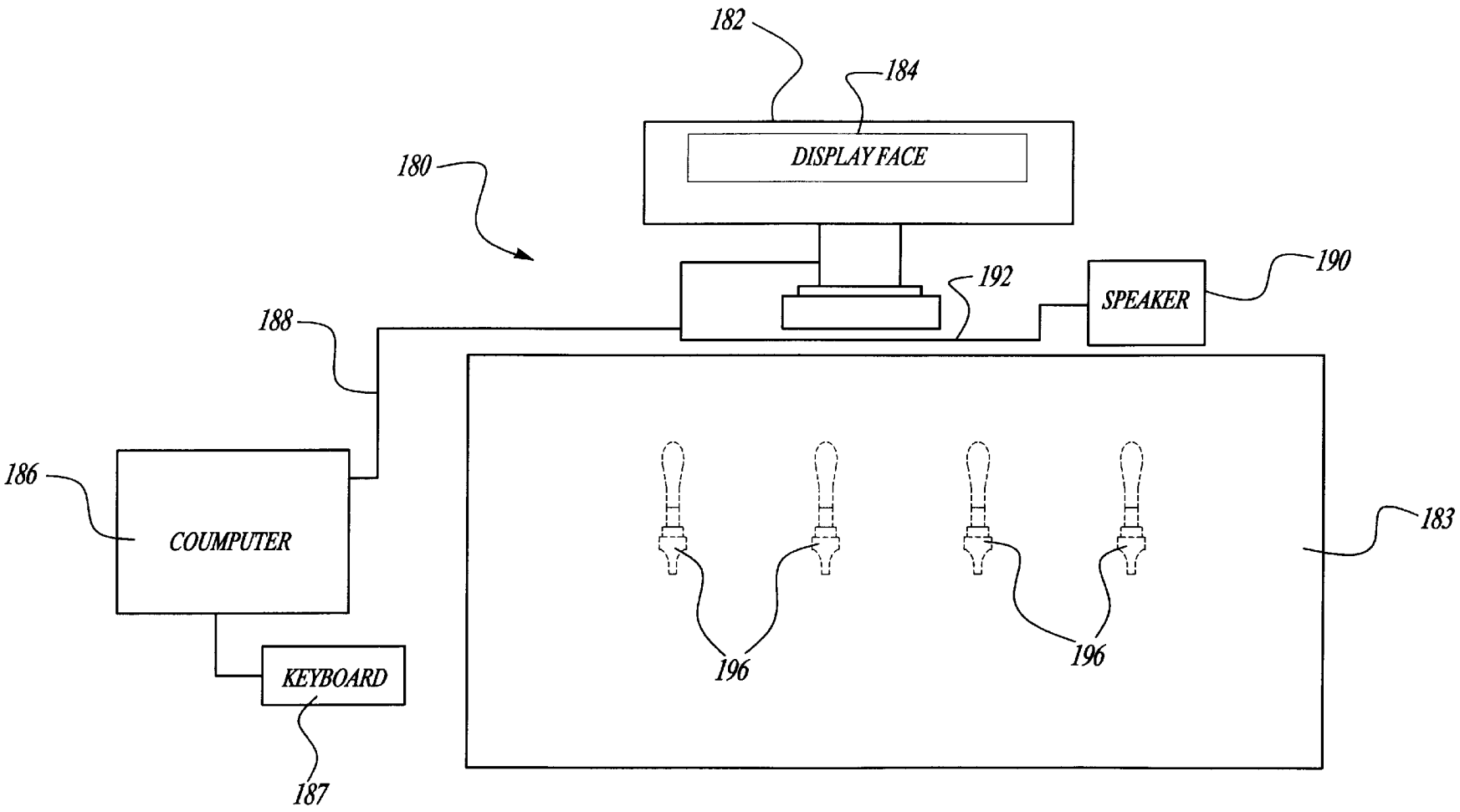
FIG. 9 is a view of an audio/visual display system according to a further preferred embodiment of the present invention which is mounted atop a tower of individual beverage dispensers and which includes a stand alone computer hard drive.

Referring finally to FIG. 9, a yet further variant of the audio/visual display system 180 is shown according to the present invention and includes a display structure 182 which is mounted in pedestal fashion atop a beverage dispenser assembly 183 and provides at least one advertising display face 184 according to a further known construction. The audio/visual display 180 according to the present embodiment is similar in respects to that previously identified in FIG. 1 and includes a separate computer or hard drive 186 with internal processing means (not shown) and a separate keyboard entry unit 187 operatively connected to the hard drive 186. The computer/hard drive 186 communicates with the display structure through an output line 188, such line typically extending to an input port which in turn communicates directly to the display 184. A stand alone speaker 190 is communicated by a further branching line 192 to the computer/hard drive 186 and operates to playback an audio output concurrent with the provision of both textual and graphical visual displays on the display 184. Finally, a row of individual beverage dispensers, identified by spigots 196 are provided at spaced intervals along the beverage dispenser assembly, such assembly 183 conventionally being a beer tower or like structure which permits a number of different beverages to be dispensed from a common source.

Having disclosed my invention, it is readily apparent that it teaches a novel and useful audio/visual display stem system incorporated in a beverage dispenser assembly. Additional preferred embodiments will become apparent to those skilled in the art to which it pertains without deviating from the scope of the appended claims.

I claim:

1. An audio/visual display system incorporated into a beverage dispenser assembly, the dispenser assembly including a spigot, a flow/non-flow dispensing handle operatively engaging the spigot and a selected beverage for dispensing through the spigot, said display system comprising:

a structure arrayed atop the dispenser assembly, said structure including at least one advertising display;

processor means for producing a first output corresponding to a visual display for presentation on said at least one advertising display, said processor means further producing a second output corresponding to an audio component associated with said visual display, audio generation and output means being provided for broadcasting said audio component;

program play means in operative communication with said processor means for presenting desired first and second outputs by said display system; and program customizing means in operative communication with said processor means for creating additional of at least one of said first and second components for presentation by said display system.

2. The audio/visual display system according to claim 1, said processor means further comprising a central processor unit incorporated within said structure and a power input source in operative communication with said central processor unit, said at least one advertising display and said audio generation and output means.

3. The audio/visual display system according to claim 2, said audio generation and output means further comprising a sound integration circuit in operative communication with a selected output of said central processor unit, an audio output transducer being operatively communicated by an output of said sound integration circuit and located upon a surface of said structure in proximity to said at least one advertising display.

4. The audio/visual display system according to claim 2, said program play means further comprising a control button arranged at a location on said structure and in operative communication with an input of said central processor unit, said control button being selectively depressed to activate/deactivate said power input source and to access a selection menu from said central processor unit which is presented upon said at least one advertising display.

5. The audio/visual display system according to claim 4, said program customizing means further comprising a programming port of said structure, a computer keyboard being operatively connected to said programming port and an interface connector converting key entered variables into an appropriate digitized format for input into said central processor unit.

6. The audio/visual display system according to claim 2, the flow/non-flow dispensing handle of said dispenser assembly being capable of incorporating said display system therein.

7. The audio/visual display system according to claim 2, said display system including said structure adapted to be mounted atop a tower including a plurality of individual beverage dispensers.

8. The audio/visual display system according to claim 1, further comprising a separate computer hard drive incorporating said processor means which is in operative communication with said advertising display in said structure, said audio generation and output means including at least one speaker connected to said hard drive and positioned in proximity to said advertising display.

9. The audio/visual display system according to claim 8, said program customizing means further comprising a keyboard in operative communication with said computer hard drive for key entering first and second output variables for presentation by said advertising display and said speaker.

10. The audio/visual display system according to claim 1, said at least one advertising display further comprising a dot matrix vacuum fluorescent display.

11. The audio/visual display system according to claim 1, said at least one advertising display further comprising a light emitting diode display.

12. The audio/visual display system according to claim 1, said at least one advertising display further comprising a first planar face arrayed on a first side of said structure and a second planar face arrayed on a second side of said structure.

13. The audio/visual display system according to claim 1, the flow/non-flow dispensing handle of the dispenser assembly being adapted to incorporate said structure of said dispenser assembly therein, said advertising display further including a circular extending display screen capable of scrolling a visual display.

14. The audio/visual display system according to claim 1, said visual display of said first output further comprising a textual component and a graphical component.

* * * * *